US006318711B1

(12) United States Patent
Auston, Jr.

(10) Patent No.: US 6,318,711 B1
(45) Date of Patent: Nov. 20, 2001

(54) FASCIA ATTACHMENT TOOL AND METHOD

(76) Inventor: John E. Auston, Jr., 22436 N. 20th Pl., Phoenix, AZ (US) 85024

( * ) Notice: Subject to any disclaimer, the term of this patent is extended or adjusted under 35 U.S.C. 154(b) by 0 days.

(21) Appl. No.: 09/517,233

(22) Filed: Mar. 2, 2000

(51) Int. Cl.[7] ..... B25B 5/14
(52) U.S. Cl. ..... 269/41
(58) Field of Search ..... 269/41, 45, 152, 269/153, 154, 155, 37; 52/702, 127; 298/215; 29/281.1, 281.5, 281.6

(56) References Cited

U.S. PATENT DOCUMENTS

| | | | | |
|---|---|---|---|---|
| 4,340,100 | | 7/1982 | Anderson, II . | |
| 4,836,517 | | 6/1989 | Vossler . | |
| 5,054,755 | | 10/1991 | Hawkes . | |
| 5,088,682 | | 2/1992 | Gibbe . | |
| 5,192,059 | * | 3/1993 | Silver | 269/41 |
| 5,228,667 | | 7/1993 | Bridegum . | |
| 5,611,189 | * | 3/1997 | Fleck | 269/41 |
| 5,746,421 | * | 5/1998 | Bowerman | 269/41 |

* cited by examiner

*Primary Examiner*—Robert C. Watson
(74) *Attorney, Agent, or Firm*—Frank J. McGue

(57) ABSTRACT

A fascia installation tool and method therefore is provided for installing fascia boards. The tool comprises a flat plate adapted to be mounted to a beam. The flat plate has an upper edge aligned with an upper surface of a beam and a front edge aligned to a front surface of a beam. An L-shaped plate has a first leg mounted to the flat plate with the first leg extending forwardly and downwardly parallel to the upper edge and a second leg extending upwardly and forwardly at a right angle from the first leg. The second leg, the first leg and the front edge form a cradle adapted to receive a fascia board therein. The cradle aligns the top of the fascia board to an upper surface of a beam.

8 Claims, 1 Drawing Sheet

FASCIA ATTACHMENT TOOL AND METHOD

TECHNICAL FIELD

This invention relates to fascia construction tools and methods, and, more particularly, to a tool and method which allows a single user to attach fascia boards to joists, trusses, rafters and borders.

BACKGROUND OF THE INVENTION

Fascia is used for cosmetic purposes to improve the aesthetics of the exterior of a building by covering the protruding rafters or joists of roof. Fascia generally comes in one of four sizes, normally 2 inches thick and either 6, 8, 10 or 12 inches wide and are designated as 2×6, 2×8, 2×10 or 2×12. Usually, fascia is installed along the eaves or the gable end of a roof. Because fascia boards are typically very long and unwieldy, the installation task usually requires two or more persons; one person holding the board at one end while the other aligns and nails the board into the rafters or outriggers of the roof.

The present tools and methods for attachment of fascia to building requires a plurality of individuals and an excess amount of time thereby costing the construction industry, and ultimately the consumer, a great deal of money. Thus, there is a great need to provide a new method for installing fascia more quickly and cheaply.

U.S. Pat. No. 4,340,100 entitled "Rafter Support Rig" which issued on Jul. 20, 1982 to Anderson, II provides a rafter jig made up of an angular rafter bracket and a rafter support swingably connected to the bracket.

U.S. Pat. No. 4,836,517 entitled "Fascia Board Installing Apparatus" which issued on Jun. 6, 1989 to Vossler includes a U-shaped frame which engaging cooperates with a rectangular shaped frame for attachment to a rafter or outrigger.

U.S. Pat. No. 5,054,755 entitled "Joist Hanger Mounting Tool" which issued on Oct. 8, 1991 to Hawkes provides a hand tool for mounting U-shaped joist hangers on header beams.

U.S. Pat. No. 5,088,682 entitled "Facia Installation Holder" which issued on Feb. 18, 1992 to Gibbs provides a L-shaped bracket having one let adapted for attachment to a roof with a support member attached to a second downwardly extending leg for supporting a facia board.

U.S. Pat. No. 5,228,667 entitled "Facia Board Holder Clamp" which issued on Jul. 20, 1993 to Bridegum provides a combination clamping and holding device for mounting facia board to an eave or gable outrigger.

None of the known prior art disclose the device set forth herein.

SUMMARY OF THE INVENTION

It is an object of this invention to provide a tool and method for allowing a single user to hang fascia board.

It is an object of this invention to provide a tool and method for hanging fascia board quickly and cheaply.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
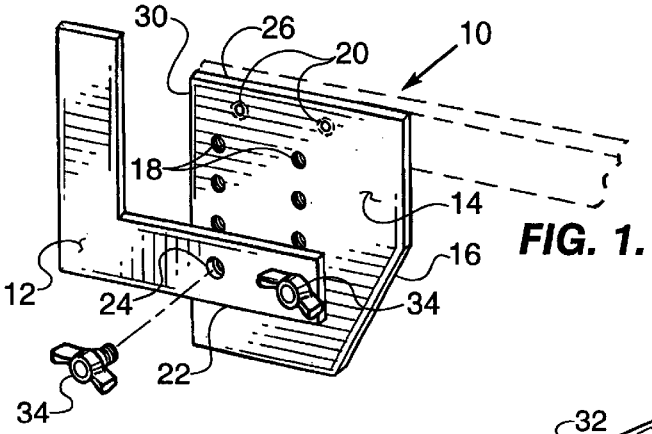
FIG. 1 is a perspective view of the present invention.
Figure 2:
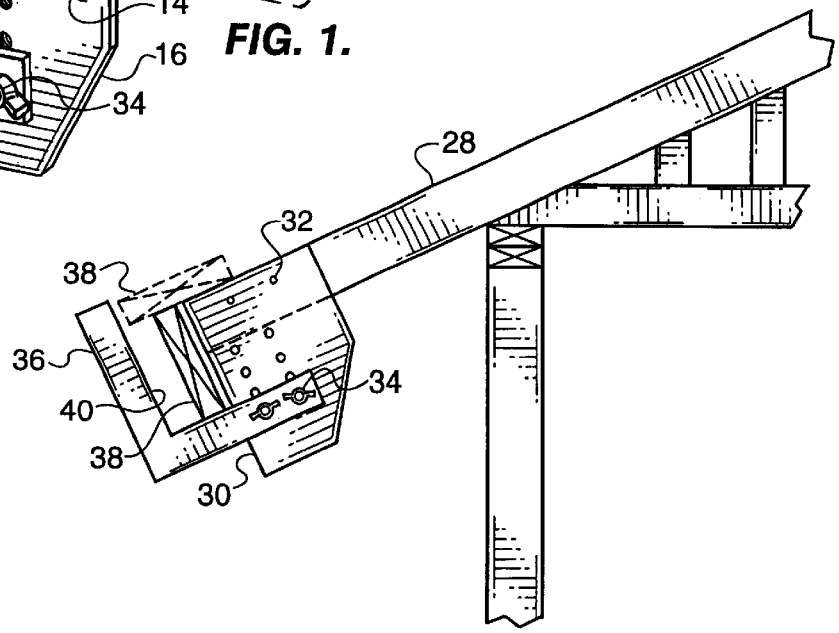
FIG. 2 is a side view of the present invention mounted on a joist showing how a fascia board is mounted therein.
Figure 3:
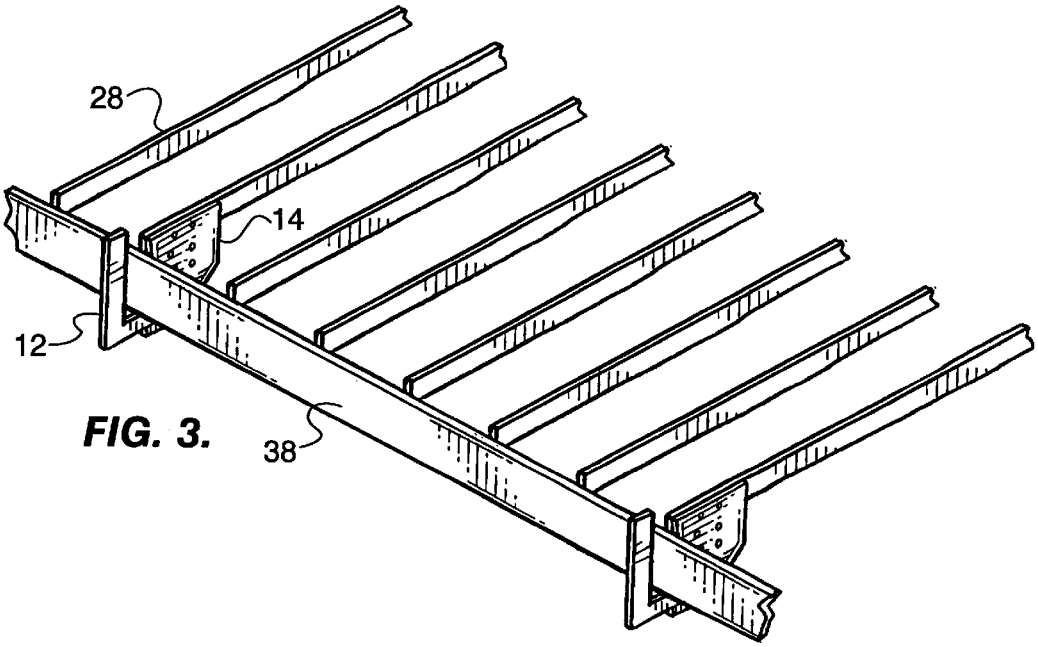
FIG. 3 is a perspective view of the present invention with a fascia board in place.

Referring more particularly to the drawings by characters of reference, FIGS. 1–3 disclose a a fascia installation tool 10 comprising an L-shaped plate 12 and a flat plate 14. Flat plate 14 generally rectangular with one cut corner 16 which is useful for short overhangs to prevent the tool from hitting the top plate and/or wall studs. Flat plate 14 further includes eight threaded holes 18 arranged in horizontally oriented pairs, each member of a pair also comprising a member of one of two parallel columns. In the preferred embodiment, indicia, commonly designations for the most popular types of fascia boards described previously, are positioned next to each pair of horizontally oriented threaded holes 18. Flat plate 14 further includes two nail holes 20 paired horizontally and positioned proximate to an upper edge 26 of plate 14.

As best seen in FIG. 2, flat plate 14 is positioned whereby upper edge 26 is aligned with the upper surface of a beam 28 while a front edge 30 is aligned with the front surface of beam 28. The term "beam" in the present specification should be understood to include joists, trusses, rafters, gable outriggers, and other equivalent components. Nails 32 are driven through nail holes 20 into beam 28 to secure flat plate 14 thereto. As best seen in FIG. 3, usually two tool 10 combinations are needed for each installation, though, of course, more could be used if desired.

It will be understood by those skilled in the art that other methods of securing plate 14 to beam 28 are possible, as, for example, screws.

A first leg 22 of L-shaped plate 12 includes two mounting holes 24 which mate with one of the horizontally oriented pairs of threaded holes 18. The user selects which pair of threaded holes 18 to employ based upon the size of the fascia board to be mounted. The distance between upper edge 26 and each pair of holes 18 is equal to ½ to ¾ inch greater than the width of the fascia board corresponding to that pair of holes 18 to allow for some up and down adjustment of fascia board plus the distance from the upper edge of first leg 22 to mounting holes 24. In the presently preferred embodiment, two wing nut screws 34 are employed to secure L-shaped plate 12 to flat plate 16 in the desired position. First leg 22 extends parallel to beam 28 and forwardly and downwardly therefrom.

A second leg 36 extends forwardly and upwardly at a right angle from first leg 22 to form L-shaped plate 12. In the presently preferred embodiment, second leg 36 extends about the width of a fascia board 38 above beam 28. In combination, second leg 36, first leg 22 and the front edge of flat plate 14 form a fascia board receiving cradle 40.

As best seen in FIG. 2, fascia board 38 is laid flat atop beams 28 (in shadow) until the leading edge of board 28 encounters that portion of second leg 36 extending above beam 28. Fascia board 38 is then rotated about a long axis to be received within cradle 40. Use of the proper pair of holes 18 generally aligns the top of board 38 with the upper surface of beam 28. Board 38 is slid laterally, vertically (if needed) and longitudinally until positioned as desired, then nailed in place to beam 28. Because of the support of cradle 40, such positional adjustments can be easily accomplished by one user. Once nailed in place, tool 10 is removed by simply prying nails 32 from beam 28.

Although only certain embodiments have been illustrated and described, it will be apparent to those skilled in the art that various changes and modifications may be made therein without departing from the spirit of the invention or from the scope of the appended claims.

What is claimed is:

1. A fascia installation tool for installing fascia boards, the tool comprising:

a flat plate having means for mounting to a beam, the flat plate having an upper edge for aligning with an upper surface of a beam and a front edge for aligning to a front surface of a beam, and an L-shaped plate having a first leg mounted to the flat plate, the first leg extending forwardly and downwardly parallel to the upper edge and a second leg extending upwardly and forwardly at a right angle from the first leg, the second leg, the first leg and the front edge forming a cradle adapted to receive a fascia board therein, and the flat plate further including a plurality of pairs of holes, each member of a pair comprising a member of one of two parallel columns, the plurality of pairs corresponding to a plurality of fascia board sizes, the first leg being mounted to one of the plurality of pairs of holes by a pair of attachment means, the distance from the upper edge to the one of the plurality of pairs of holes plus the distance from the upper surface of the first leg to the one of the plurality of pairs of holes corresponding to the width of one of the plurality of fascia board sizes corresponding to the one of the plurality of pairs of holes.

2. The fascia installation tool of claim 1 further comprising indicia associated with each of the plurality of pairs of holes identifying which of the plurality of fascia board sizes corresponds thereto.

3. The fascia installation tool of claim 1 comprising four pairs of holes.

4. The fascia installation tool of claim 3 wherein the four pairs of holes correspond to fascia board sizes of 2×6, 2×8, 2×10 and 2×12, respectively.

5. The fascia installation tool of claim 1 wherein the attachment means comprises threading in each of the holes and a pair of correspondingly threaded wing nut screws.

6. The fascia installation tool of claim 1 wherein the means for mounting to a beam comprises two nail holes paired horizontally and positioned proximate to the upper edge.

7. A fascia installation tool for installing fascia boards, the tool comprising:

a flat plate having means for mounting to a beam, the flat plate having an upper edge for aligning with an upper surface of a beam and a front edge for aligning to a front surface of a beam, and an L-shaped plate having a first leg mounted to the flat plate, the first leg extending forwardly and downwardly parallel to the upper edge and a second leg extending upwardly and forwardly at a right angle from the first leg, the second leg, the first leg and the front edge forming a cradle adapted to receive a fascia board therein, the flat plate further including a plurality of pairs of holes, each member of a pair comprising a member of one of two parallel columns, the plurality of pairs corresponding to a plurality of fascia board sizes, the first leg being mounted to one of the plurality of pairs of holes by a pair of attachment means, the distance from the upper edge to the one of the plurality of pairs of holes plus the distance from the upper surface of the first leg to the one of the plurality of pairs of holes corresponding to the width of one of the plurality of fascia board sizes corresponding to the one of the plurality of pairs of holes, indicia imprinted on the flat plate associated with each of the plurality of pairs of holes identifying which of the plurality of fascia board sizes corresponds thereto.

8. The fascia installation tool of claim 7 comprising four pairs of holes corresponding to fascia board sizes of 2×6, 2×8, 2×10 and 2×12, respectively.

* * * * *